US005153972A

United States Patent [19]

Fabrizio

[11] Patent Number: 5,153,972

[45] Date of Patent: Oct. 13, 1992

[54] METHOD AND DEVICE FOR THE SELECTION OF THE LOOPS OF HEDDLES IN AN AUTOMATIC HEDDLING MACHINE

[76] Inventor: Gironi Fabrizio, Via del Palco, 26/a, Prato (FI), Italy, 50047

[21] Appl. No.: 764,920

[22] Filed: Sep. 24, 1991

[30] Foreign Application Priority Data

Sep. 25, 1990 [IT] Italy ..... 9496 A/90

[51] Int. Cl.[5] ..... D03J 1/14

[52] U.S. Cl. ..... 28/206; 28/205

[58] Field of Search ..... 28/205, 206, 207, 203, 28/204

[56] References Cited

U.S. PATENT DOCUMENTS

| | | | |
|---|---|---|---|
| 1,149,137 | 8/1915 | Hathaway et al. | 28/205 X |
| 1,153,857 | 9/1915 | Blair | 28/205 X |
| 4,543,696 | 10/1985 | John et al. | 28/206 |
| 4,549,333 | 10/1985 | Stahli | 28/205 |
| 4,815,498 | 3/1989 | Gryson et al. | 28/207 X |

FOREIGN PATENT DOCUMENTS

| | | | |
|---|---|---|---|
| 391614 | 9/1965 | Switzerland | 28/205 |

*Primary Examiner*—Werner H. Schroeder

*Assistant Examiner*—Bibhu Mohanty

*Attorney, Agent, or Firm*—McGlew & Tuttle

[57] ABSTRACT

To bring about selection of the loops of heddles of the flat type with open heads, individually from the packet of loops hanging on a track whose horizontal guides pass through both heads, upper and lower, of the loops, use is made of: a binary track which guides the loops, having two sections joined together by a step descending in the direction of the heddling zone; and, beyond said step: a plate for stopping the packet of loops in such a way that that loop which comes in turn to the front of the packet and which is pushed against said plate, is unsupported by the track; and, above said step and tight against said plate: a flat-headed vertical blade only slightly thinner than one loop and having reciprocating motion, which blade acts axially on the peak of said loop that is unsupported by the track in such a way as to cause it to drop down said step onto the lower leg of the track and enable it to be selected from the packet; and, at the side of said step, a pusher, having horizontal reciprocating motion, which acts parallel with the track on the backs of the noses, upper and lower, of the loop so selected, to cause it to advance along the lower leg of the loop track, toward the heddling zone.

8 Claims, 2 Drawing Sheets

METHOD AND DEVICE FOR THE SELECTION OF THE LOOPS OF HEDDLES IN AN AUTOMATIC HEDDLING MACHINE

FIELD AND BACKGROUND OF THE INVENTION

The present invention relates to a method for the selection of the loops of heddles of the flat type with open heads in an automatic heddling machine and a device for carrying out said method.

It is known that automatic heddling machines must be able to select the loops of heddles from the packet of loops in the magazine, that is they must be able to separate each loop in the packet from the next to enable it to be placed individually in position for heddling.

A known type of heddler comprises a loop selection device consisting of a blade whose flat point is wedged into the inverted V-sectioned space bounded by the flanks of the heads of two adjacent loops in the packet; but this known device requires the heads of the loops to be previously worked, that is rounded off on both flanks to give said V profile.

Another known type of heddler comprises what is commonly termed a "screw nut" loop selection device which consists of a stem with a short threaded portion which engages as the stem rotates on itself in a corresponding slot through the body of each loop and separates it from the packet; this known device too can only use loops whose bodies have been previously given an extra hole for said particular use.

SUMMARY AND OBJECTS OF THE INVENTION

The object of the present invention is to provide a loop selection device for an automatic heddling machine that will be able to operate with all the flat loops commonly available, thereby eliminating the aforementioned disadvantages.

This result has been achieved in accordance with the invention by adopting the idea of giving the binary track, which guides the hanging loops, a step descending in the direction of the heddling zone and, beyond said step, of arranging a stop to stop the packet of loops in such a way that that loop which comes in turn to the front of the packet, and is pushed against said stop, is unsupported by the track, and of arranging, above said step and tight against said packet stop, a flat-headed blade only slightly thinner than the loops and having vertical reciprocating motion, which blade acts axially on the peak of said first loop of the packet to cause it to drop down said track step and enable it to be selected from the packet; and at the side of said step, of arranging a pusher having horizontal reciprocating motion, which acts parallel with the track on the backs of the noses, upper and lower, of the loop so selected, to cause it to advance along the lower leg of the loop track toward the heddling zone.

The advantages obtained with the invention consist essentially in that it is possible to select all commonly available flat-type heddle loops having open heads, provided they are all strictly of equal thickness; in that selection is sure, precise, fast and reliable even with packets having a great number of loops; and in that a device according to the invention is of very simple construction and moderate cost.

The various features of the novelty which characterize the invention are pointed out with particularity in the claims annexed to and forming a part of this disclosure. For a better understanding of the invention, its operating advantages and specific objects obtained by its use, reference is made to the accompanying drawings and descriptive matter in which a preferred embodiment of the invention is illustrated.

DETAILED DESCRIPTION OF THE PREFERRED EMBODIMENT

Figure 1:
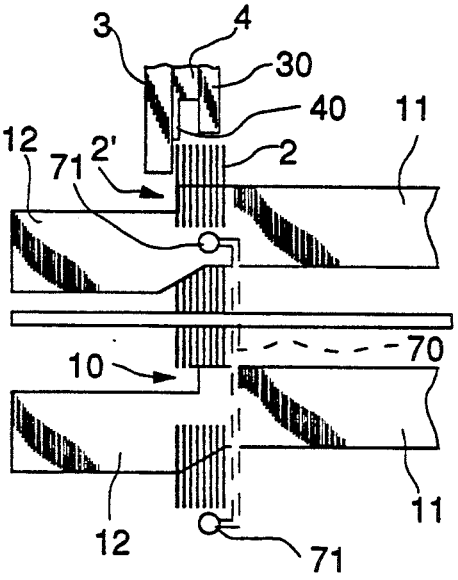
FIGS. 1, 2 and 3 diagrammatically show the initial, intermediate and final phases in the selection of a loop according to the invention.
Figure 2:
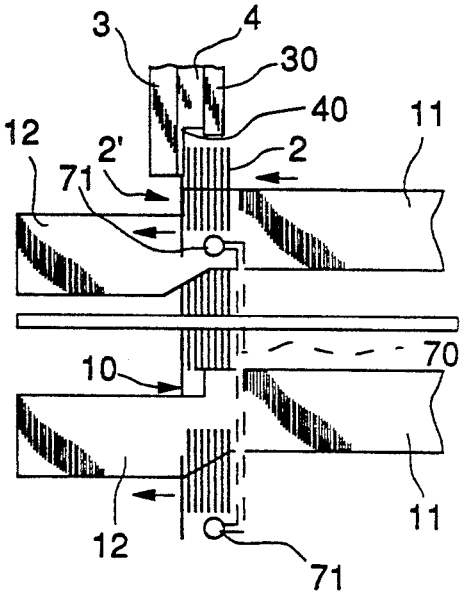
Figure 3:
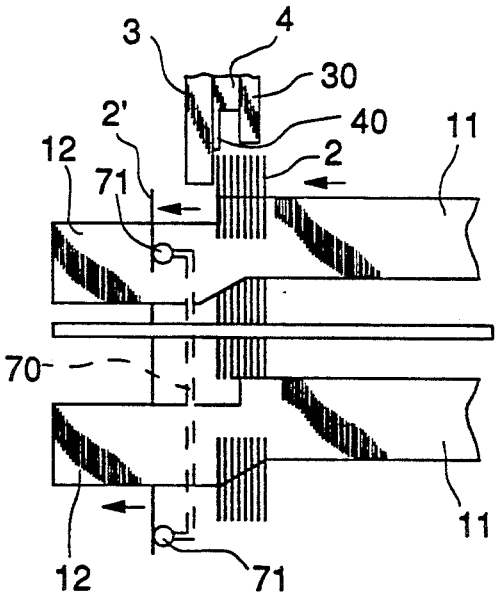

Reduced to its basic structure and with reference to FIGS. 1–3 in the accompanying drawings, the method for selecting the loops of flat-type heddles having open heads in an automatic heddling machine in accordance with the invention comprises the following phases:

(a) pushing, from behind, the packet of loops for heddling, hanging from a binary track whose horizontal guides pass through the two heads, upper and lower, of the loops, against a plate serving as an end-of-travel for the packet, which plate is placed beyond a step in the track descending in the direction of the heddling zone, in such a way that the loop at the front of the packet is unsupported by the track, but is held by the force of friction resulting from the compression of the packet with the next loop in the packet and with said stop; this taking place in cooperation with the special shape possessed by the upper head of the loops;

(b) acting downward on the peak of said loop at the front of the packet to cause the loop to drop down said step, rest upon the lower leg of the track and enable it to be selected from the packet;

(c) advancing the loop so selected from the packet, along the lower leg of the track toward the heddling zone.

Figure 4:
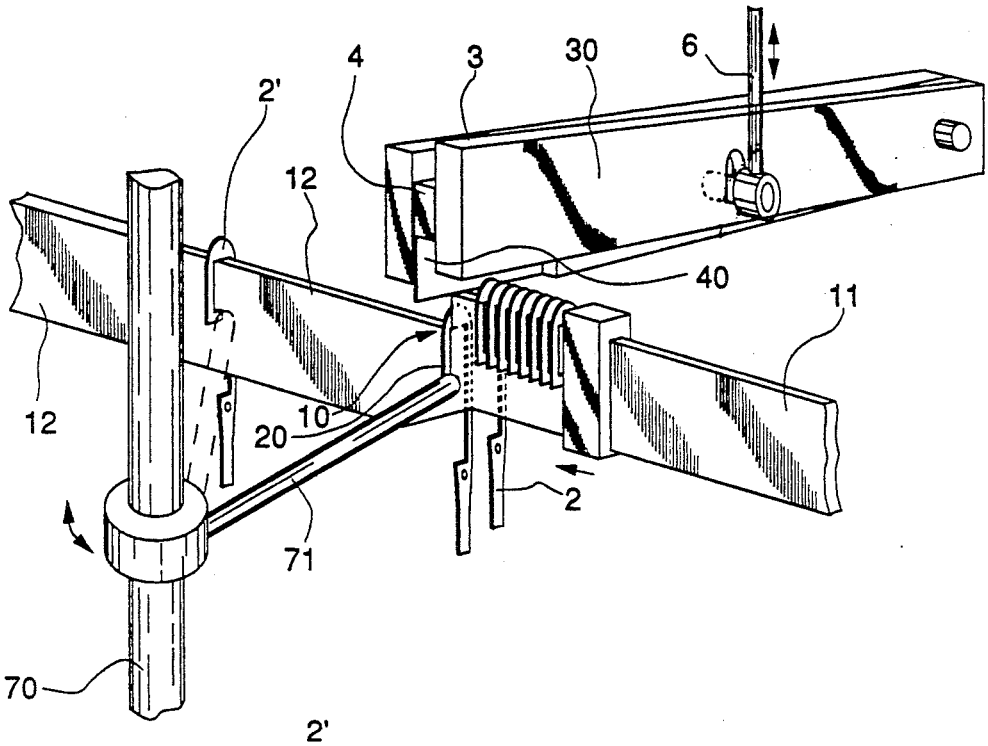
FIG. 4 shows an axonometric projection of a detail of the selection device according to the invention.
Figure 4:
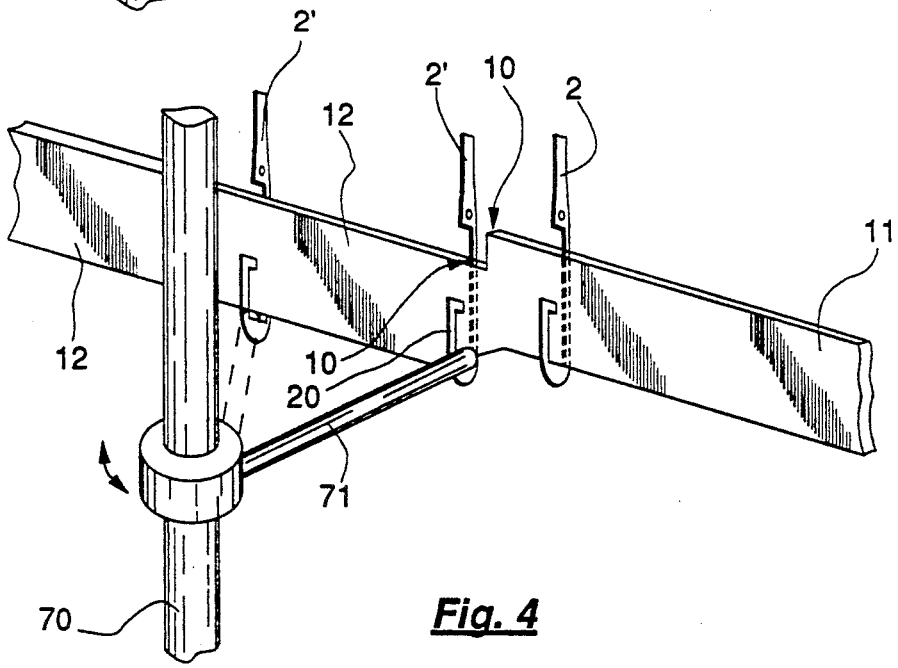

Meanwhile, the device according to the invention for carrying out said method comprises, with reference to FIG. 4 of the accompanying drawings:

a binary track 1 with the guides, upper and lower, contained in a vertical plane to hold and guide the hanging loops 2 of the heddles which guides are in two sections 11, 12 at different levels joined by a step 10;

a fixed plate 3 placed beyond said step 10 in a crosswise position overhanging the lower section 12 of the upper guide of the binary track 1 so as to form a stop to stop the packet of loops 2 which is being pushed from behind: the gap between the step 10 and said plate 3 being just greater than the thickness of one loop and the gap between said plate 3 and the binary track 12 being just greater than the height of the peak of a loop 2;

a blade 4 with a flat head 40 which is articulated upon a horizontal pin 5 and held and guided by the aforesaid plate 3 and by a counterplate 30 in such a way that the head 40 fits into the gap between the step 10 and the plate 3. Known means (for example with a connecting rod and crank 6) are provided to impart a vertical reciprocating movement to the blade 4 whose descending path provides the action on the peak of the loop 2' held by the plate 3, thereby removing it from the level of the upper section 11 of the track and taking it down the step 10 and onto the lower section 12 of the track;

a pusher 7 consisting of a vertical shaft 70 and two horizontal arms 71 intended to engage from behind the two noses 20 of the loop 2', which has been placed on the lower leg 12 of the track, and to advance it toward the heddling zone through the leftward rotation of the shaft 70—said shaft 70 being in reciprocating motion so as to bring the arms 71 back in position to take the next selected loop.

Operation is as follows. The push from behind on the packet of loops 2 causing the packet to advance along section 11 of the track 1 means that the loop 2', which is steadily advancing to the front of the packet, stops up against the plate 3 where it is beyond the step 10 and is unsupported by the track but is held by friction owing to compression on the packet, by the plate 3 and by the next loop 2, and by the particular shape of the loop's own upper head. The blade 4 comes down on its head 40, pushing on the peak of the loop 2' and so pushing it down the step 10 onto the lower leg 12 of the track, after which the arms 71 of the pusher 7 move the loop 2' so selected from the packet forward in the direction of the heddling.

In practice, however, the details of execution may vary in equivalent ways, as regards shape, size, arrangement of the components and the type of materials used, though without departing from the scope of the idea of the solution adopted, and therefore remain within the limits of the protection granted by the present patent of industrial invention.

I claim:

1. A method for the selection of loops of heddles in an automatic heddling machine in which the loops for heddling are advanced in a hanging position along a binary track set up in a vertical plane with its horizontal guides passing through two open heads of the loops of the heddles; which method comprises:

(a) pushing, from behind, a packet of the loops for heddling against a plate serving as an end-of-travel stop for the packet, where said plate is placed beyond a step in the binary-track, said step-descending in such a way that the loops which steadily advances at the front of the packet of loops for heddling is unsupported on a upper leg of the track and held there by the force of friction by said plate and by the next loop in the packet, and also by the particular shape of the loop's own upper head;

acting with downward force on the peak of said loop at the front of the packet to cause the loop to drop down the step of the binary track and rest upon the lower leg of a binary-track and to enable it to be selected from the packet;

(c) advancing the loop so selected from the packet, along the lower leg of the track in the direction of heddling.

2. A device for the selection of loops of heddles in a heddling machine according to the method as claimed in claim 1; which device comprises:

a binary track for moving the loops in a hanging position, in which the guides which are, upper and lower legs, are in two sections at different levels, the sections being joined together by a descending step;

a plate fixed crosswise to the track beyond said step so as to form an end-of-travel stop for a packet of loops which is being pushed along the upper leg of the track and so a first that loop of the packet which is beyond step is unsupported by the track;

a vertical blade with a flat head which is articulated by means of a horizontal pin and held and guided between said plate and a counterplate, in such a way that said head fits into a gap between the step of the track and the plate, means being provided to impart to the blade a vertical reciprocating movement;

and a pusher with a vertical rotating shaft and two horizontal arms for acting parallel to the track on the backs of noses of a selected loop to advance it toward the heddling zone.

3. The device as claimed in claim 2, wherein the rise of said step of the track is slightly greater than the height of a peak of a loop.

4. The device as claimed in claim 2, wherein the gap between the edge of the track step and the edge of said plate is only slightly greater than the thickness of one loop.

5. The device as claimed in claim 2, wherein the edge of said track step is vertical or is backwardly inclined with respect to the direction of advance of the loops.

6. The device as claimed in claim 2, wherein the gap between the lower leg of the track and the base of the plate is slightly greater than the peak of a loop.

7. The device as claimed in claim 2, wherein the head of said blade is only slightly thinner than one loop.

8. The device according to claim 2, wherein the shaft of said pusher rotates in one direction or in a reciprocating manner.

* * * * *